US005188303A

United States Patent [19]

Hoof

[11] Patent Number: 5,188,303

[45] Date of Patent: Feb. 23, 1993

[54] APPARATUS FOR PROTECTING DISKS OF A HAMMER-CRUSHER ROTOR WITH A PROTECTIVE SHIELD

[75] Inventor: Erhard Hoof, Eschweiler, Fed. Rep. of Germany

[73] Assignee: Albert Hoffmann KG, Eschweiler, Fed. Rep. of Germany

[21] Appl. No.: 482,562

[22] Filed: Feb. 21, 1990

[30] Foreign Application Priority Data

Feb. 23, 1989 [DE] Fed. Rep. of Germany ..... 3905492

[51] Int. Cl.[5] ..... B02C 13/04

[52] U.S. Cl. ..... 241/194; 241/197; 241/300

[58] Field of Search ..... 241/191, 194, 197, 300, 241/195, 189 R

[56] References Cited

U.S. PATENT DOCUMENTS

| | | | |
|---|---|---|---|
| 4,056,232 | 11/1977 | Linnerz et al. | 241/194 |
| 4,613,088 | 9/1986 | Hausler et al. | 241/194 X |
| 4,650,129 | 3/1987 | Newell et al. | 241/197 X |
| 4,898,334 | 2/1990 | Manschwetus | 241/194 |

FOREIGN PATENT DOCUMENTS 2605751 9/1976 Fed. Rep. of Germany .

*Primary Examiner*—Mark Rosenbaum

*Attorney, Agent, or Firm*—W. G. Fasse; D. H. Kane, Jr.

[57] ABSTRACT

A protective shield for a hammer-crusher rotor protects at least the circumferential surfaces of disks attached to and rotating with a rotor shaft. In the spacing between neighboring disks, at least one hammer is tiltably or pivotally supported on an axle rod extending at a radial spacing from the shaft through the disks. Each protective shield is formed by at least one filler body made of an especially wear resistant material. The filler bodies are arranged and secured in the free space between neighboring disks where the hammers are not located. In its installed position, each filler body has a radially outwardly facing wear resistant surface having an axial width substantially the same as or slightly wider than the axial gap width of the respective spacing. The radially outer surface of the filler bodies is approximately flush with or concentric to a circumferential outer surface of the neighboring disks. In the latter case the filler bodies project slightly radially outwardly of the circumferential outer disk surfaces.

33 Claims, 11 Drawing Sheets

13
4
2
12
14
12
6
18
17
16
31
39
IV
IV
41
17
30
40
29
26
42
R
38
17
39
25
17
1
34
48
23
35
8
7
33
32
9
10
25
19
16
24
36
III
III
37
17
II
II
24
17
15
18
6
5
3
13

APPARATUS FOR PROTECTING DISKS OF A HAMMER-CRUSHER ROTOR WITH A PROTECTIVE SHIELD

FIELD OF THE INVENTION

The invention relates to an apparatus with a protective shield for protecting at least the circumferential surfaces of the disks of a hammer-crusher rotor. The disks have disk bodies attached at a spacing from one another to the shaft of the hammer-crusher in a rotationally rigid manner so that the disks rotate with the shaft. At least one axle rod is mounted at a radial spacing relative to the shaft and at least one swingably or tiltably supported hammer is arranged on the axle rod in the space between two neighboring disk bodies.

BACKGROUND INFORMATION

Hammer-crusher rotors are used, for example, for crushing, shredding, or breaking scrap metal, such as automobile frames and bodies or other metal scraps. The hammer-crusher rotor essentially comprises a strong shaft which is rotatably and drivably supported at both of its ends in a housing of the hammer-crusher. The housing further encloses an anvil or an anvil surface. The scrap metal is crushed or broken between the rotating, impacting hammers of the hammer-crusher rotor and the respective anvil surfaces. Furthermore, the housing comprises an intake opening for the scrap material to be crushed or shredded and an outlet for the crushed or shredded material. A plurality of disks is rotationally, rigidly arranged on the shaft of the hammer-crusher rotor, so that the disks rotate with the rotating shaft. Each of the disks may comprise a respective hub and a disk body, whereby the axial width of the disk body is less than the axial width of the hub so that annular spaces are formed between neighboring disks. Each disk comprises a plurality of through-going bored holes running in parallel to the shaft and arranged at a uniform spacing from one another along a divided or pitch circle at a spacing away from the disk center and near the outer circumference of the disk body. The through-going bored holes of all the disks of the hammer-crusher rotor are aligned in a direction parallel to the lengthwise axis of the hammer-crusher rotor. An axle rod is passed through each respective set of aligning or bored holes to pass through all of the rotor disks. Thus, the arrangement is such, that the number of axle rods corresponds to the number of holes in each disk and that these rods are arranged eccentrically about and parallel to the shaft of the hammer-crusher rotor. The individual axle rods may respectively be rigidly held in end disks of the hammer-crusher rotor. According to a determined pattern, the number of hammers arranged to freely rotate on each axle rod may vary from rod to rod. The hammers each have an axial width or thickness so that they fit into the space between adjacent disk bodies, whereby during rotation of the rotor, the hammers can freely rotate about the axle rod in a segment of the circular space between two neighboring disk bodies.

When the hammer-crusher rotor is used for crushing or shredding metal scraps the parts of the hammer-crusher which come in direct contact with the scrap metal are subject to a very high wear. The wear is not only due to abrasion, for example of the disks, rather it frequently occurs that small parts or chips of the disk are chipped away so that the disks must be replaced or renewed at time intervals which may differ from disk to disk.

German Patent Publication (DE-PS) 2,605,751 discloses protective shields for hammer-crusher rotors, which are made of specially wear resistant material and which respectively comprise a circular ring segment shaped cover part and a corresponding bearing hub provided on the inner surface of the cover part. Each protective shield is arranged between two adjacent disks and is secured by its bearing hubs to a respective axle rod. The cover parts cover the circumferential surfaces of the respective adjacent disks so that all the protective shields together form an essentially closed protective shell or jacket, whereby the hammers protrude from slots in the jacket. It is the purpose of the essentially closed known protective shell or jacket to protect the outer surfaces of the rotor disks against wear. The known protective shell achieves its purpose. However, the known shell is assembled from several separate elements, namely the separate protective shields which are relatively costly and complicated due to their special shape and are therefore expensive to produce. The cover parts of the protective shields for the circumferential surfaces entail a high production cost which still does not avoid curvature errors. Any curvature errors will result in undesirable edge loading during operation of the known hammer-crusher rotor with a resulting danger of fracture or rupture.

OBJECTS OF THE INVENTION

In view of the above it is the aim of the invention to achieve the following objects singly or in combination:

to provide a protective shield for the disks of hammer-crusher rotors to effectively protect the disks from wear, abrasion, and breakage during operation;

to construct an effective shield for hammer-crushers from relatively simple and interchangeable parts so that the protective shield may be easily and cheaply installed and maintained;

to construct an effective shield for hammer-crushers from parts which may be easily and cheaply produced while avoiding production errors such as curvature errors associated with the production of more complicated parts, which, for example, require a higher precision in production; and to assure a more uniform wear, so that replacements can be made at regularly scheduled maintenance operations rather than at random intervals.

SUMMARY OF THE INVENTION

The above objects have been achieved according to the invention by a protective shield for the disks of a hammer-crusher rotor, wherein the protective shield is constructed as at least one filler body made of an especially wear resistant material and which is insertable into the free space or spacing between respective neighboring spacer disks where the filler body can be secured by mounting means in this position. Each filler body comprises a surface facing radially outwardly in its installed location. This radially outwardly facing surface has an axial width which is approximately the same as the width of the filler body between neighboring spacer disks. This radially outwardly facing filler body surface has an essentially circular contour extending essentially flush with or concentrically to an outer circumferential surface of a disk body.

It has been found that the conventional covers are not required. The filler bodies according to the invention provide sufficient protection for the circumferential surfaces of the spacer disks. Further, according to the invention the desired effective protection shield can be achieved by a plurality of filler bodies arranged one next to the other in a circumferential direction to form together a circumferentially substantially continuous but axially interrupted protective shield, which reduces the amount of damage since each filler body is relatively small so that replacement parts are cheaper, whereby maintenance costs are reduced. The protective shield according to the invention makes the known covers for the circumferential surfaces of spacer disks superfluous, and the present filler bodies may have a very simple shape so that the present filler bodies are robust, yet simple and inexpensive to produce.

It is advantageous if each filler body comprises at least one through-going bored hole to receive an axle rod for mounting the filler body on the axle rod so that no further support means are necessary. If two or more axle rods are used to secure each filler body, these rods simultaneously lock the filler bodies against tilting or pivoting. However, such locking may be achieved by other securing means. For example, the filler bodies may be sufficiently secured against tilting by arranging them so that neighboring filler bodies at least partially contact each other in the circumferential direction at sufficiently sized side faces of neighboring filler bodies.

The filler bodies may comprise a special surface contour along their outer circumferential surfaces, such as a toothed pattern, a wavy pattern, or a file-like pattern surface. In this manner, the protective shield not only provides an effective protection for the hammer-crusher rotor parts, but also simultaneously increases the effectiveness of the hammer-crusher rotor which is equipped with the present filler bodies because the contoured surfaces of the present protective shield act somewhat as additional impact crusher elements.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
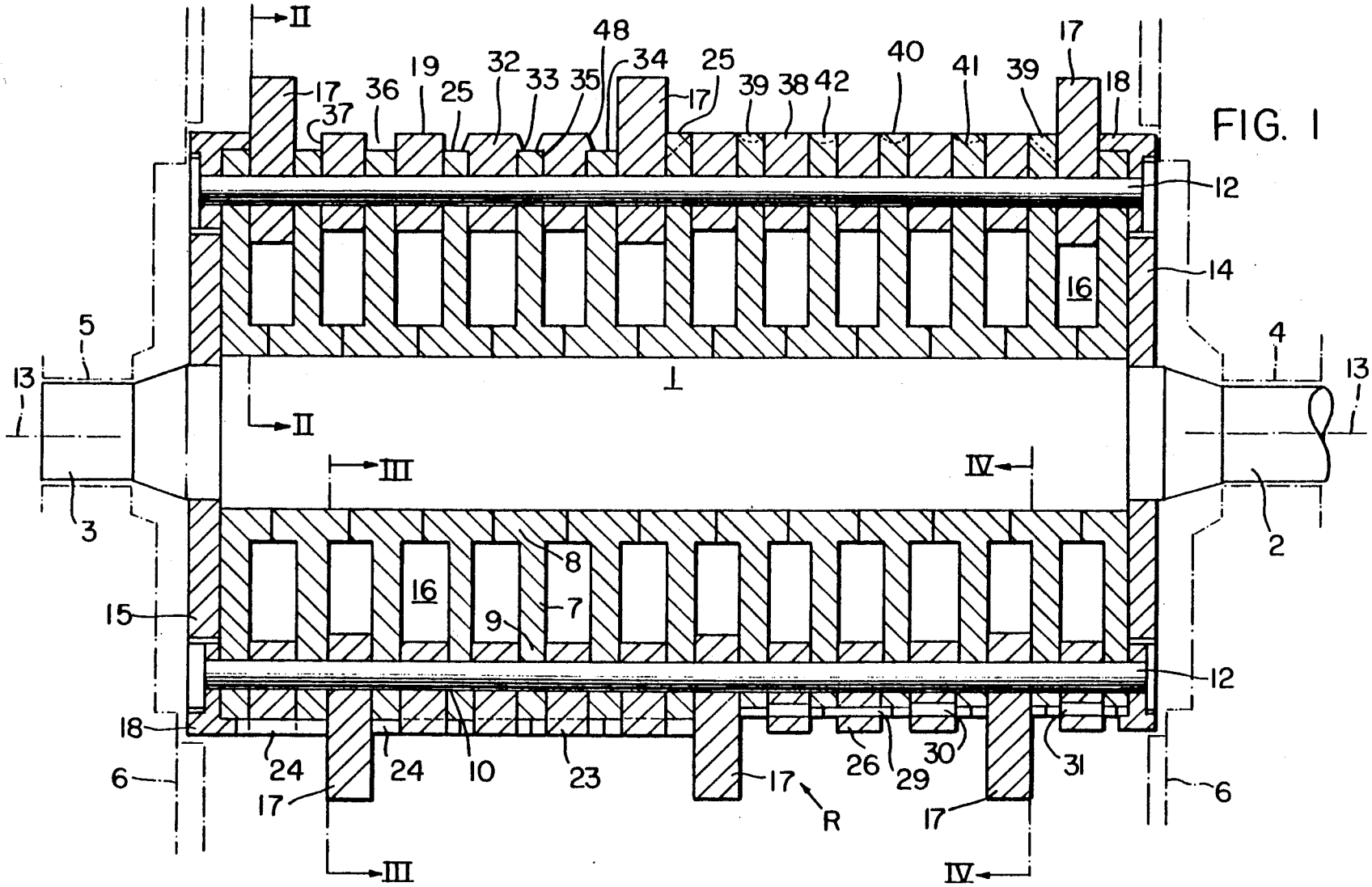
FIG. 1 is a lengthwise section through a hammer-crusher rotor showing various example embodiments of filler bodies according to the invention installed in the hammer-crusher rotor.

FIG. 1 shows a hammer-crusher rotor R essentially comprising a shaft 1 which is rotatably supported at its both ends 2 and 3 in corresponding bearing plates 4 and 5 in a housing 6. The housing 6 surrounds the hammer-crusher rotor R and typically comprises an intake opening for the material to be crushed or shredded, an anvil surface against which the material is crushed or shredded, and an outlet opening for the crushed or shredded material. The intake outlet and anvil are not essential to the disclosure of the present invention and hence are not shown in the drawings.

A plurality of spacer disks 7 is arranged along most of the axial length of the shaft 1. Each disk 7 comprises a hub 8 by which the disk 7 is rigidly attached to the shaft 1 for rotation with the shaft, for example, by means of wedges, splines, or a shaft having a polygon section. Each hub 8 is surrounded by a disk ring 9. Each disk ring 9, near its outer circumferential surface 25, comprises a plurality of through-going holes 10 that may be drilled or the like and which extend in parallel to the shaft 1. The holes 10 preferably are all arranged on the same divided or pitch circle 11 at a certain radial distance away from the central axis 13 of the shaft 1 as shown especially in FIG. 2. All of spacer disks 7 are arranged on the shaft 1 in such a manner that corresponding holes 10 of the separate disks 7 align or register with each other in the axial direction. An axle rod 12 is inserted to pass through each aligned set of through-going holes 10. Thus, each axle rod 12 extends eccentrically and in parallel to the rotational axis 13 of the shaft 1. Preferably, as shown, the hammer-crusher rotor R comprises six axle rods 12. Each axle rod 12 is secured at its ends in end rings 18 of the hammer-crusher rotor R. At both ends 2 and 3 of the shaft 1 the spacer disks 7 are secured by end disks 14 and 15.

Each disk ring 9 has a smaller axial thickness than the corresponding disk hub 8. Thus, when adjacent hubs 8 contact each other along the shaft 1, annular spaces 16 are formed in the assembled hammer-crusher rotor between respective neighboring disk rings 9. Alternatively, if each hub 8 is axially narrower than its corresponding disk ring 9, appropriate spacer bushings may be placed on the shaft 1 between adjacent disk hubs 8 to achieve the same effect and produce the annular spaces 16. Portions of separate annular spaces 16 are necessary as free play room to allow movement of hammers 17 which are arranged in a prescribed pattern or sequence, which is known as such, about the circumference of the hammer-crusher rotor. The hammers 17 are rotationally supported on the axle rods 12. As the hammer-crusher rotor rotates, the hammers 17 are positioned in an essentially radially extended position as shown in FIG. 1 due to rotational centrifugal forces. As soon as a hammer 17 meets a resistance in the form of material to be crushed or shredded, the impact force imparts a self-rotation of the hammer 17 about the axle rod 12.

The annular spaces 16 between adjacent disk rings 9 are filled out, except for the necessary free play room for the motion of the hammers 17, by means of filler bodies 19, 20, 23, 26, 32, 38, or 32' which, together form the protective shield according to the invention. All the filler bodies are made of an especially wear-resistant material. In contrast to the freely rotatable hammers 17, the filler pieces are arranged on the axle rods 12 in such a manner that they cannot carry out a self-rotation about the axle rod 12. Several possibilities exist for rotationally fixing the filler bodies so that they cannot tilt.

Figure 2:
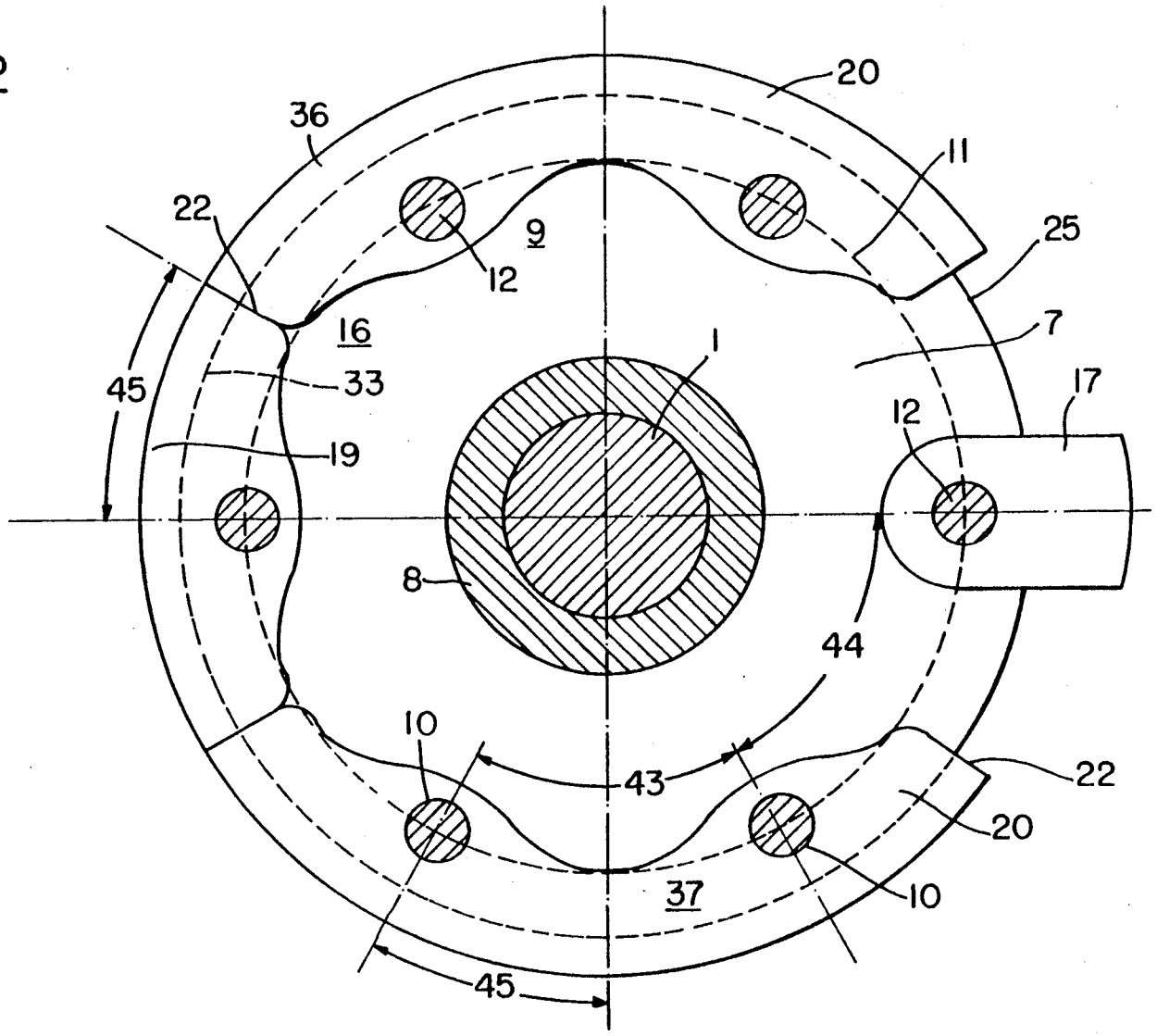
FIG. 2 is a cross-sectional view of a first embodiment of filler bodies as viewed along section line II—II of FIG. 1.

FIG. 2 is a cross-sectional view showing a first embodiment of filler bodies according to the invention fixed against tilting on the axle rods 12. As shown, double segment filler bodies 20 alternate with single segment filler bodies 19 in an annular space 16, in such a way that one double segment filler body 20 is arranged immediately to each side of a gap 21 of the annular space 16, which must remain free and clear for rotation of the hammer 17 about the axle rod 12. Each double filler body 20 has two mounting holes 10 and is held by two axle rods 12 and is thereby prevented from rotating. The filler body 19 is held by a single axle rod 12, but it cannot rotate because its ends contact the filler bodies 20. Additionally, end faces 22 sloping radially at their ends, also secure the filler bodies 19, 20 against individual movements. In this arrangement the two holes 10 in each filler body 20 are spaced from each other by a distance 43 which corresponds to the spacing distance 44 between corresponding holes 10 in the disk ring 9. Furthermore, the spacing from a hole 10 in the filler body 20 to a neighboring end face 22 of the filler body 20 is of equal distance for both holes 10 in the filler body 20, whereby the filler bodies are symmetrical relative to a radial line bisecting a filler body.

In this context it is expressly pointed out that the just described attachment of the filler bodies is but one simple possibility of securing the filler bodies to the axle rods 12. Many other possibilities exist and the described attachment is not mandatory. The attachment, however must assure that radially outwardly directed centrifugal forces and radially inwardly directed impact forces arising during operation are properly taken up. The mounting means for the filler bodies may be so constructed that the different forces acting in different directions are taken up by different components of the mounting means.

Figure 3:
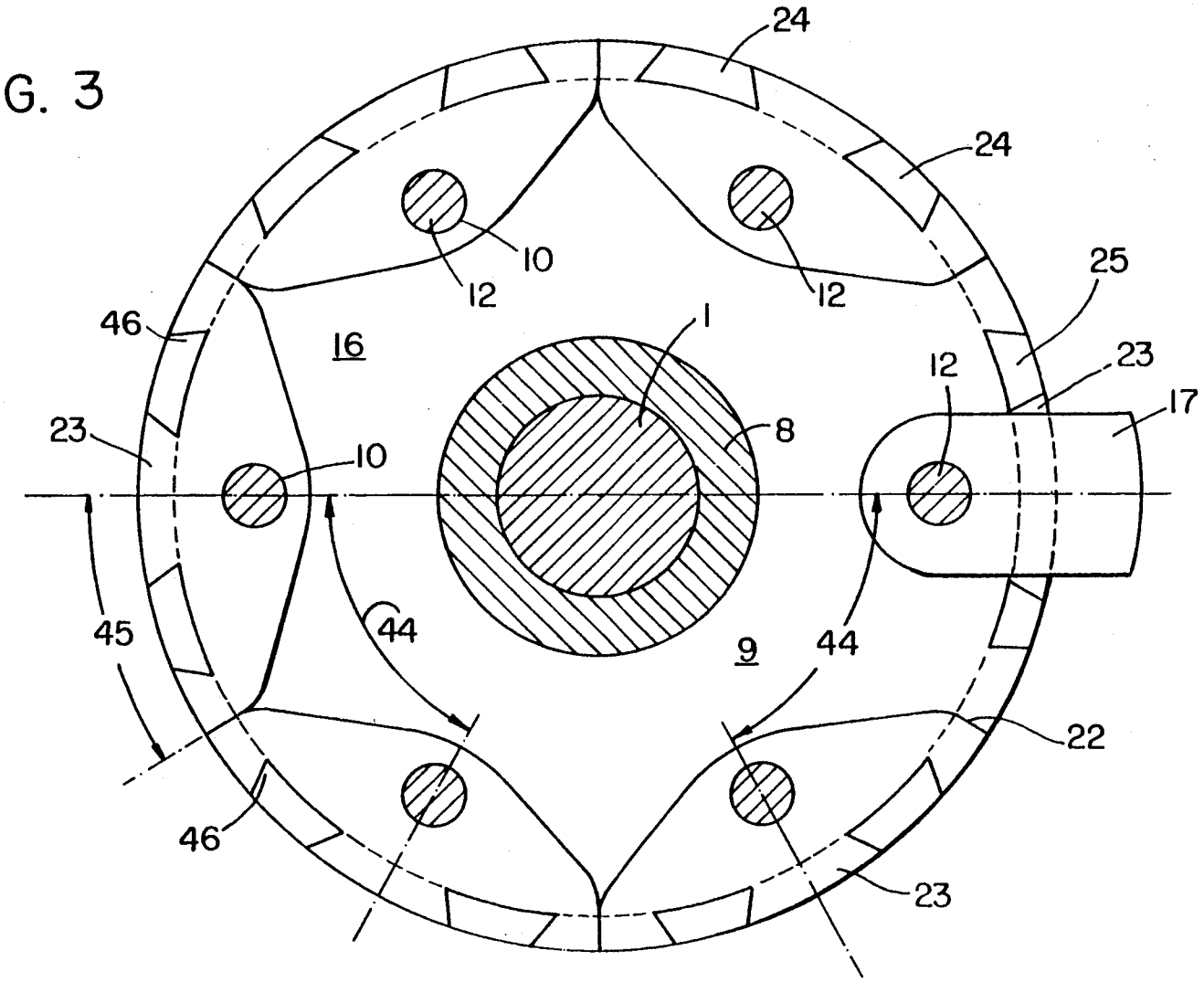
FIG. 3 is a cross-section similar to that of FIG. 2, but taken along section line III—III of FIG. 1.
Figure 8:
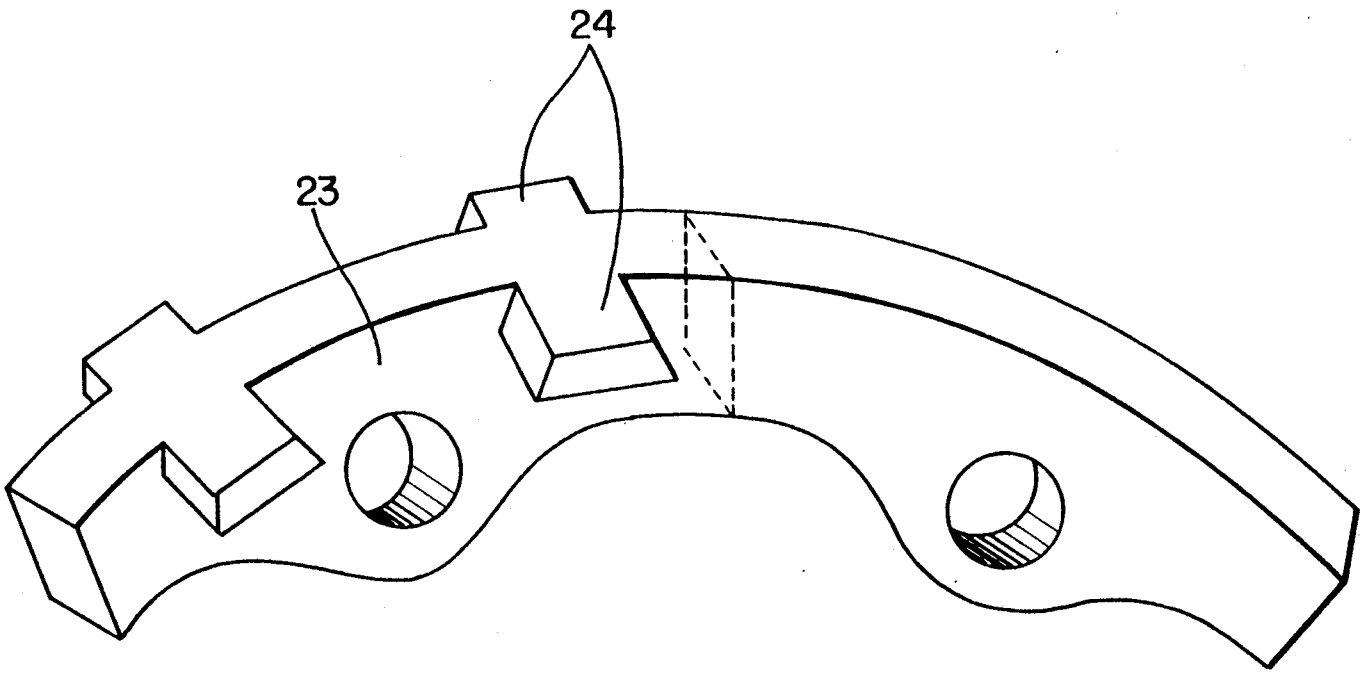
FIG. 8 is a detailed perspective view of a special embodiment of a filler body having lateral, axially extending retainer bars.

FIGS. 3 and 8 shows another embodiment of filler bodies 23 and different means for mounting these filler bodies 23 to prevent rotation about the axle rod 12. All the filler bodies 23 have the same shape and size and are each held by a single axle rod 12 in the annular space 16. Each filler bodies 23 is held against rotation about the axle rod 12 by means of contact with neighboring filler bodies 23 along radially sloped end faces 22 and by means of outrigger retainer bars 24 which may have a dovetailed shape cross-section and which are inserted in correspondingly shaped axially extending grooves 46 of the filler body 23. Actually, the retainer bars 24 alone are sufficient for preventing the rotation of the filler bodies 23 about the axle rod 12 even without the mutual contact of the end faces 22. As shown in a detailed view of FIG. 8, the outrigger retainer bars 24 may be integrally cast with the filler body 23, rather than being separate bars 24 held in dovetailed grooves 46. In the embodiment shown in FIG. 3, two retainer bars 24 are arranged on each filler body 23, so that one bar 24 is located on each side of the axle rod 12 to which the respective filler body is secured.

As shown especially in the lower left-hand portion of FIG. 1, the retainer bars 24 of each filler body are in contact with and supported by the circumferential surfaces 25 of the neighboring spacer disks 7. Each retainer bar 24 extends beyond the thickness of the filler body 23 to cover approximately half of the width of the respective neighboring spacer disk 7. However, in the area of the hammers 17 the corresponding retainer bar 24 extends completely across the entire width of the neighboring spacer disk 7. In this manner, the crushing impact points within the working range of the hammers 17 along the circumferential surface 25 of the spacer disk 7 are protected.

The width of the retainer bars 24 in the circumferential direction is considerably less than the circumferential dimension of the filler bodies 23. Thus, as the hammer-crusher rotor R rotates, the relatively narrow retainer bars 24 function as impact bars and thus can contribute to the fine shredding of the material being crushed. Simultaneously, the retainer bars 24 protect the axle rods 12 against impact forces by transmitting to the spacer disks 7 any impact forces arising in the filler bodies 23.

Figure 4:
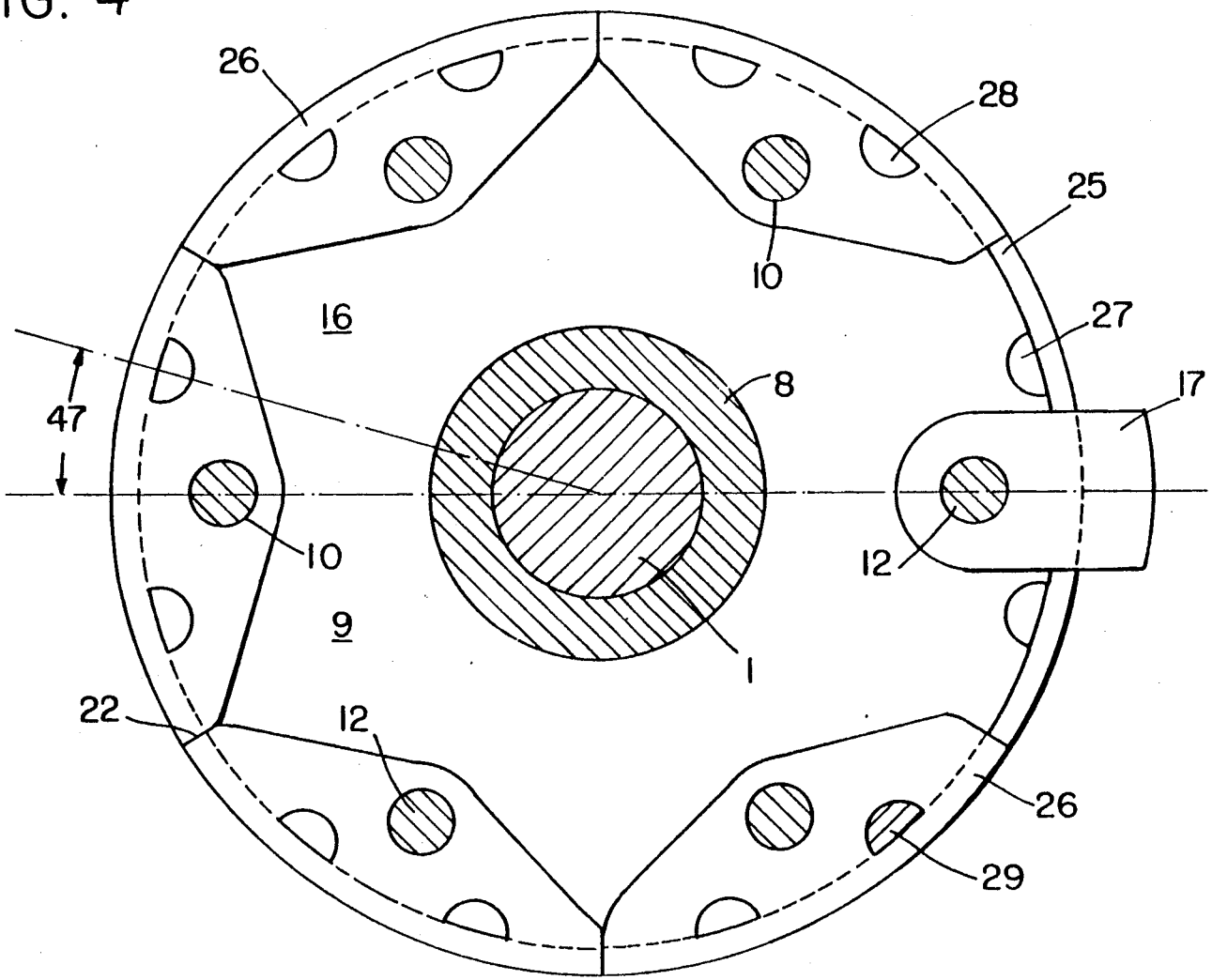
FIG. 4 is a further cross-section similar to that of FIG. 2, but showing another variation of the present filler bodies and taken along the line IV—IV of FIG. 1.
Figure 10:
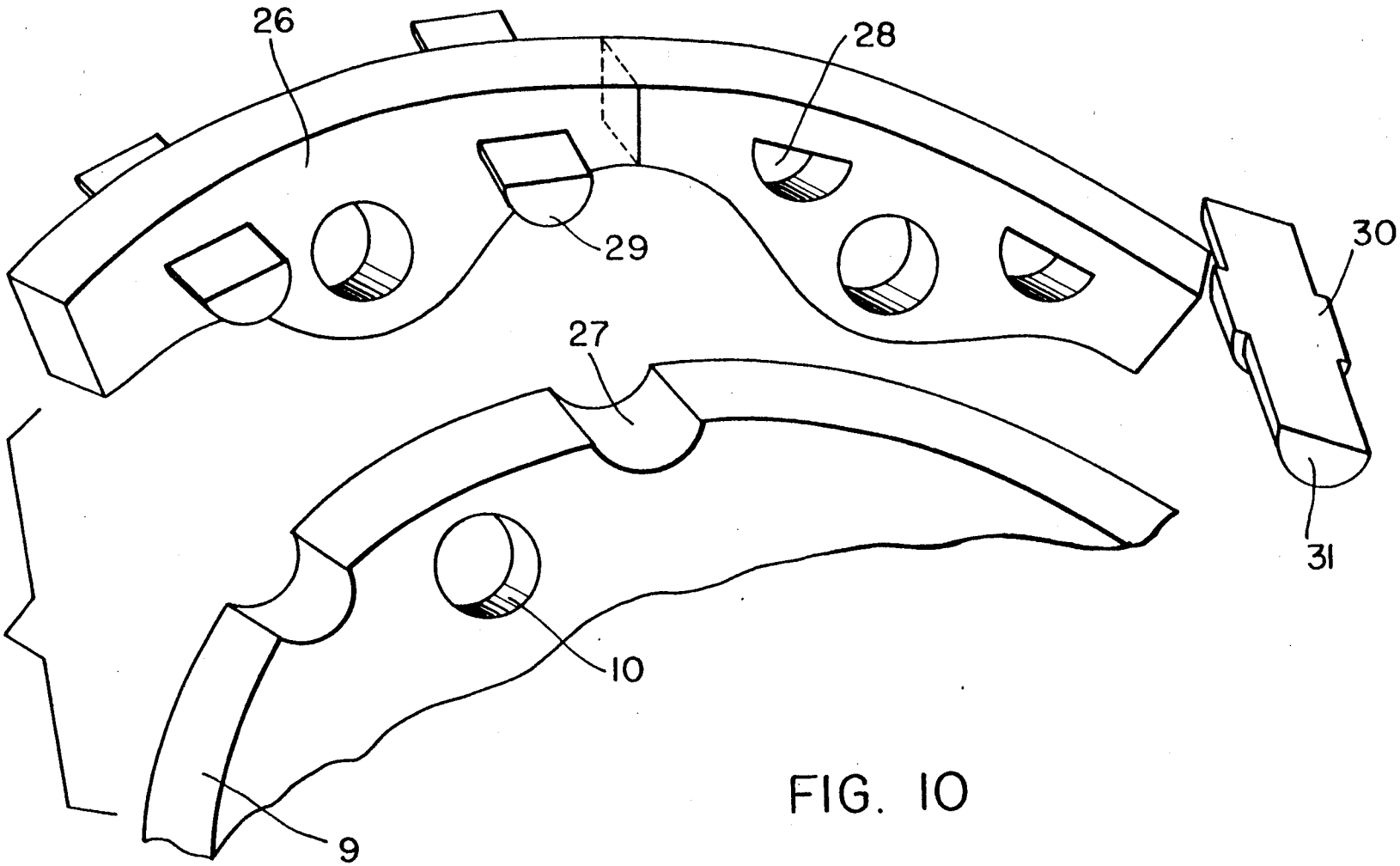
FIG. 10 is a detailed exploded, disassembled, perspective view of a filler body according to the invention and a corresponding rotor disk section with a corresponding retainer bolt.

FIG. 4 shows a further embodiment of filler bodies 26 and a further possibility of securing the filler bodies 26 against rotation about the axle rods 12. As shown, a plurality of semicircular grooves 27 are provided on the circumferential surface 25 of the spacer disk 7. The diameter of each semicircular groove 27 may, for example, be approximately equal to the diameter of the axle rod 12. The filler bodies 26 are shaped as individual segment type configurations and may comprise radially sloping end faces 22 for contacting neighboring filler bodies 26. Each filler body 26 comprises two corresponding semicircular mounting holes 28 which extend in the axial direction through the filler body 26 and which are at least as large or larger than the grooves 27 of the spacer disks 7. Semicircular mounting bolts 29 pass through the mounting holes 28 and engage the grooves 27. Each semicircular bolt 29 extends axially beyond the filler body 26 over approximately half of the axial width of the adjacent spacer disk 7 as shown, especially in the lower right-hand portion of FIG. 1. In the areas near the hammer 17 the mounting bolt 29 will extend across the entire width of the spacer disk 7. As shown in FIG. 10, the semicircular bolt 29 may be integrally cast with the filler body 26 rather than being a separate bolt 29 inserted into a semicircular hole 28 in the filler body 26. As shown in FIG. 4, the bolts 29 are preferably spaced at a distance 47 from the holes 10 as seen in the circumferential direction which typically corresponds to the spacing of impact points on the circumferential surface 25 of the disk rings 9 in the area of the hammer 17. In this manner, the impact points near the operating area of the hammers 17 may simultaneously be protected by the bolts 29. Furthermore, these bolts 29 may secure each filler body against rotation.

It should be noted in general that while each of these filler bodies 26 is shown as individual segments arranged on a single axle rod 12, such filler bodies may instead be made as double segments, each sitting on two rods 12 or even as larger filler elements as shown, for example, in the embodiments of FIGS. 5A, 5B, 8, 9, and 10.

FIG. 10 shows a further embodiment of a bolt 31 which is illustrated in an installed view in the lower right-hand portion of FIG. 1. The semicircular bolt 31 has a thicker central portion 30 which especially prevents an axial movement of the semicircular bolt 31 in the vicinity of the hammers 17. In this arrangement, the size of the semicircular hole 28 in the filler body 26 corresponds to the size of the thicker central portion 30 of the semicircular bolt 31 while the semicircular groove 27 of the ring disk 9 has a smaller diameter corresponding to the smaller diameter of the extending portions of the semicircular bolt 31. The effects of the semicircular bolts 29 and 31 as shown in an installed arrangement in the lower right-hand portion of FIG. 1 is essentially the same as that of the retainer bars 24, except for an additional impact effect.

The right half of the upper left hand portion of FIG. 1 shows a further embodiment of filler bodies 32 comprising lengthwise side faces 35 and a contact edge 33 running along each side 35. The contact edges 33 of each filler body 32 are in contact with and supported by a respective circumferential edge 34 of a respective adjacent spacer disk 7, whereby the filler body 32 is fixed or secured against a self-rotation movement. Each filler body 32 is a single segment filler part mounted on a single axle rod 12. The supporting contact of the contact edges 33 on the circumferential edge 34 of the spacer disk 7 effectively insulates the axle rod 12 from impact forces which arise in the filler body 32 and which are then transmitted into the disks 7. The contact edges 33 extend over the entire circumferential length, or just over a portion of the circumference of at least one or both of the lengthwise sides 35 of the filler body 32. Radially outwardly from the contact edges 33 the lengthwise sides 35 of the filler bodies 32 are bevelled or angled before meeting the circumferential outer surface of the filler piece 32.

As shown especially in the upper left and lower right portions of FIG. 1, the filler bodies 19, 23, 26, and 32 may respectively protrude radially beyond the circumferential surface 25 of the spacer disk 7 so that circumferential annular spaces 36 are formed between adjacent filler bodies and radially outside of the spacer disks 7. In this manner, the effect of the filler bodies to protect the circumferential surfaces 25 is improved. The radially protruding portion of the filler bodies may have a special surface contour or profile 49 as shown, for example, in FIG. 5 for the filler body 32' which has a wavy surface contour 49. Also, as mentioned above, all types of filler bodies are made of an especially wear resistant material.

An alternative embodiment is shown in the upper right-hand portion of FIG. 1, where the filler bodies 38 are shaped as simple circular ring segments arranged between respective rotor spacer disks 39. Each segment shaped filler piece 38 is penetrated by and mounted on at least one axle rod 12 which serves to hold the filler body 38 in position. In the brand new condition of the filler bodies which is shown in the upper right-hand portion of FIG. 1, the outer circumferential surfaces 40 of the rotor spacer disks 39 and the corresponding outer circumferential surfaces of the filler bodies 38 are in flush alignment with each other to form a single flush cylindrical shell. During operation of the hammer-crusher rotor, the unprotected circumferential surfaces 40 of the spacer disks 39 will initially wear and abrade faster than the filler bodies 38 because the filler pieces 38 are made of a different especially wear resistant material. Thus, eventually the circumferential surfaces 40 of the spacer disks 39 take on a wear contour which is indicated by the dashed line 41. Through this wearing process, circumferential annular free spaces 42 are formed which grow to approximately the sectional size of the circumferential annular free spaces 36 described above. When the circumferential surfaces 40 have worn to the point of forming circumferential annular spaces 42, the protective effect of the filler pieces 38 is increased and the wear rate of the rotor disks 39 is greatly reduced or slowed down.

Figure 6:
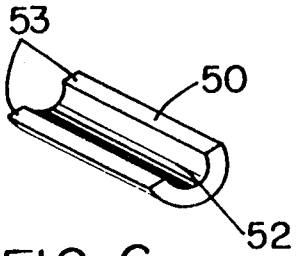
FIG. 6 is a perspective view of a supporting half-shell.
Figure 9:
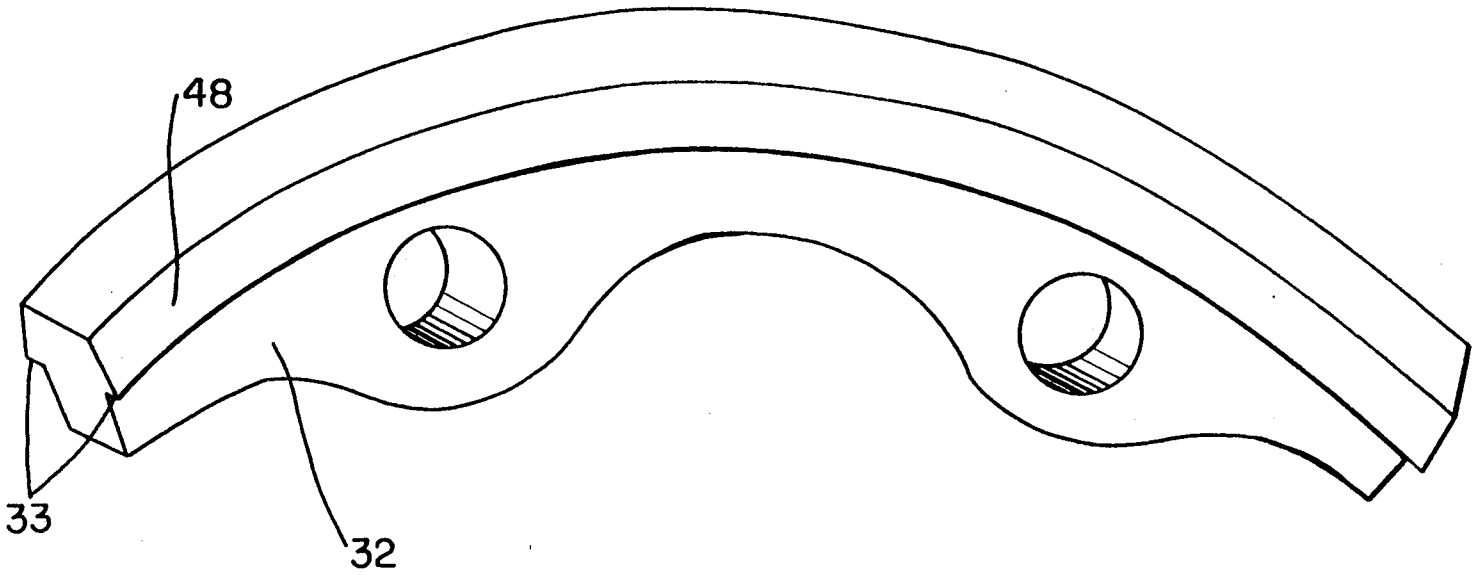
FIG. 9 is a view similar to that of FIG. 8, but showing a further variation of a filler body having lateral contact edges.

FIGS. 5A, 5B, 6, and 7 show other possibilities for at least partially unloading the axle rods 12. A filler body 32' as shown especially in FIG. 5A, or, for example, a filler body 32 as shown in FIG. 9, comprises at least one through-going hole 10' with a 180° sector 51 of the hole having a larger diameter and the remaining sector having a smaller diameter. An associated bored mounting hole 10 in a corresponding ring disk 9 has the same shape, that is to say, it comprises a 180° sector having a larger diameter. A half cylindrical shell 50, as shown in detail in FIG. 6, is inserted into the hole 10' of the filler body 32' and the hole 10 of the ring disk 9. Then, the axle rod 12 is inserted through the respective aligned mounting holes 10 and 10' to form the arrangement shown in FIG. 7. The inner surface 52 of the half-cylindrical shell 50 aligns with the inner wall of the smaller diameter portion of the hole 10' in the filler body 32' and the hole 10 in the ring disk 9 to form a smooth cylindrical bore as the bearing for the axle rod 12. In this embodiment any radial loads applied to the filler bodies are transmitted to the half-cylindrical shell 50 and through its edge faces 53 to the corresponding countersurfaces of the holes to be transmitted into the ring disks 9. In this manner, any forces which arise in the filler pieces and which are not totally or at least partially taken up by other measures are bypassed around the axle rods 12.

Each filler body piece preferably has an axial width so that its side surfaces 37 shown in FIGS. 1 and 2 are as close as possible to the adjacent side surfaces of the ring disk 9 in order to effectively fill or close any gap therebetween.

Figure 7:
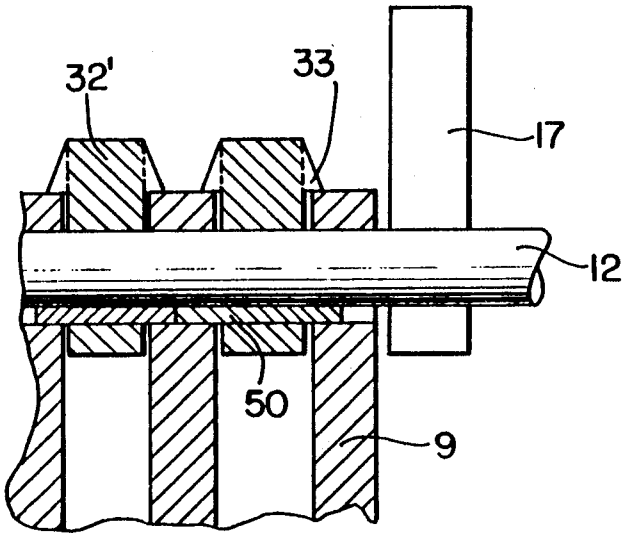
FIG. 7 is a lengthwise section through a detailed view of a hammer-crusher rotor with filler bodies and installed supporting half-shells.
Figure 7B:
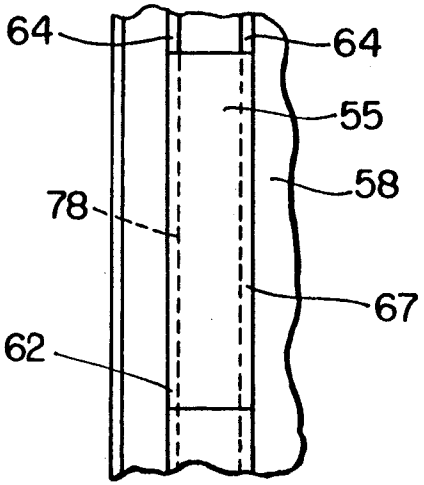
FIG. 7B is a radial detailed view in the direction of the arrow A of FIG. 7A.
Figure 7C:
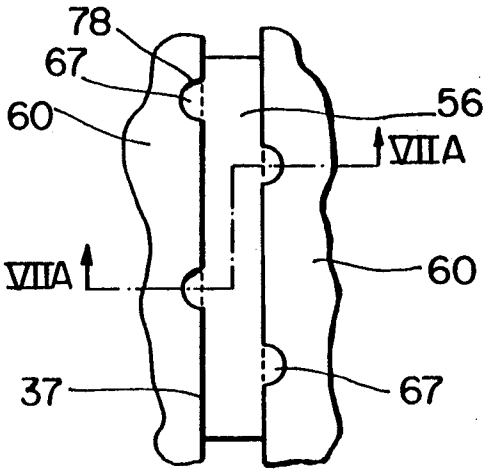
FIG. 7C is a view similar to that of FIG. 7B, but showing another embodiment of a filler body.
Figure 7A:
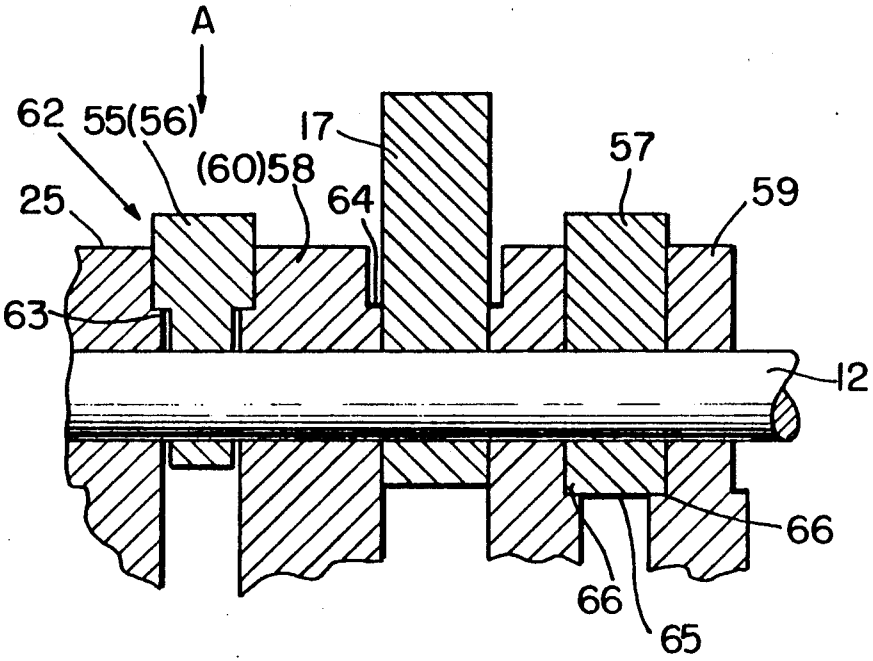
FIG. 7A is a view similar to that of FIG. 7, showing a section along section line VIIA—VIIA in FIG. 7C and illustrating several different filler bodies.

FIG. 7A shows a similar sectional view as FIG. 7, but of different filler body embodiments. FIG. 7A shows a composite view of three different embodiments of filler bodies 55,56, and 57. Filler body 55 essentially corresponds in its basic form to the simple flat-sided filler body 19 of FIG 1. However, filler body 55 comprises a radially outer widened head rim 62 which protrudes radially outwardly from the outer circumferential surface 25 of the adjacent rotor disks 58 in a manner similar to the radial protrusion of filler body 19. However, the widened head rim 62 is also partially in the adjacent rotor disks 58 which each comprise a corresponding annular rabbet groove 64. The radially inner surface of this rabbet groove 64 forms a countersurface which contacts and supports the bottom surface 63 of the filler body 55. In this manner, forces effective on the filler body 55 and directed radially inwardly, are transmitted through the contacting surfaces 63 and 64 directly into the disk 58 rather than entering into the axle rod 12.

A similar load transmission effect is achieved by the filler bodies 57 also shown in FIG. 7A. The filler body 57 is a simple flat-sided filler body and does not comprise a widened head rim like the filler body 55. Instead, the filler body 57 has one uniform width across its entire radial extension. A corresponding rabbet groove in the adjacent rotor disk 59 for receiving the filler body 57, extends radially inwardly to a greater extent in the rotor disk 59 than in the rotor disk 58. The inner circumferential surface 65 of the filler body 57 contacts and rests on the corresponding ledge or countersurfaces 66 of the rotor disk 59 which again transmits any radially inwardly directed forces acting on the filler body 57 in order to shield or unload the axle rod 12.

FIG. 7B shows a radial view of the filler body 55 taken in the direction of arrow A of FIG. 7A. A similar view would also apply to the filler body 57.

FIG. 7C shows another embodiment of a filler body 56 as a view in the direction of arrow A of FIG. 7A. However, for these views to correspond, the sectional view of FIG. 7A must be taken along the line VIIA—VIIA of FIG. 7C. As shown in FIG. 7C, the filler body 56 has a form substantially as simple as filler body 19 or the filler body 55, and is arranged between adjacent spacer disks 60. However, the filler body 56 comprises one or more essentially radially extending ridges 67 on each of its side surfaces 37. The radial extension of the ridges 67 ends flush with the outer circumferential surface of the filler body 56. The ridges 67 may be staggered or alternatingly arranged on opposite side surfaces 37 of the filler body 56 as seen in the circumferential direction as shown in FIG. 7C. The ridges 67 may extend radially inwardly along the entire radial extension of the filler body which would correspond to the filler body 57 shown in FIG. 7A or may extend only over a head rim region with a radial dimension corresponding, for example, to the head rim 62 of the filler body 55. In this case, the radially inner end surface of the ridges 67 rests against the countersurfaces 64 of the neighboring spacer disks 58. Thus, when spacer disks 58 are provided, filler bodies 55 or filler pieces 56 may be installed and used as desired. If instead the ridges 67 extend over the entire radial depth of the filler body 56, then the filler piece 56 could be used instead of the filler body 57 in conjunction with spacer disks 59. As a further alternative, it would be possible to use spacer disks 60 comprising radially extending grooves 78 in the side surfaces of each spacer disk 60, whereby the size, shape, and location of the grooves 78 corresponds to the size, shape, and location of the ridges 67 so that the grooves 78 receive the ridges 67 in a form-fitting and force transmitting manner. In this arrangement, the ridges 67 transmit not only radial, but also circumferentially directed forces from the filler bodies to the spacer disks, thereby unloading and protecting the axle rod 12. However, this is only true when the ridges 67 of the filler bodies 56 are received by grooves 78 of the spacer disks 60. Any portion of the ridges 67 which protrudes radially beyond the outer circumferential surface 25 of the adjacent spacer disk, provides an additional crushing or shredding impact effect so that the operating effectiveness of such a rotor is improved.

Figure 4A:
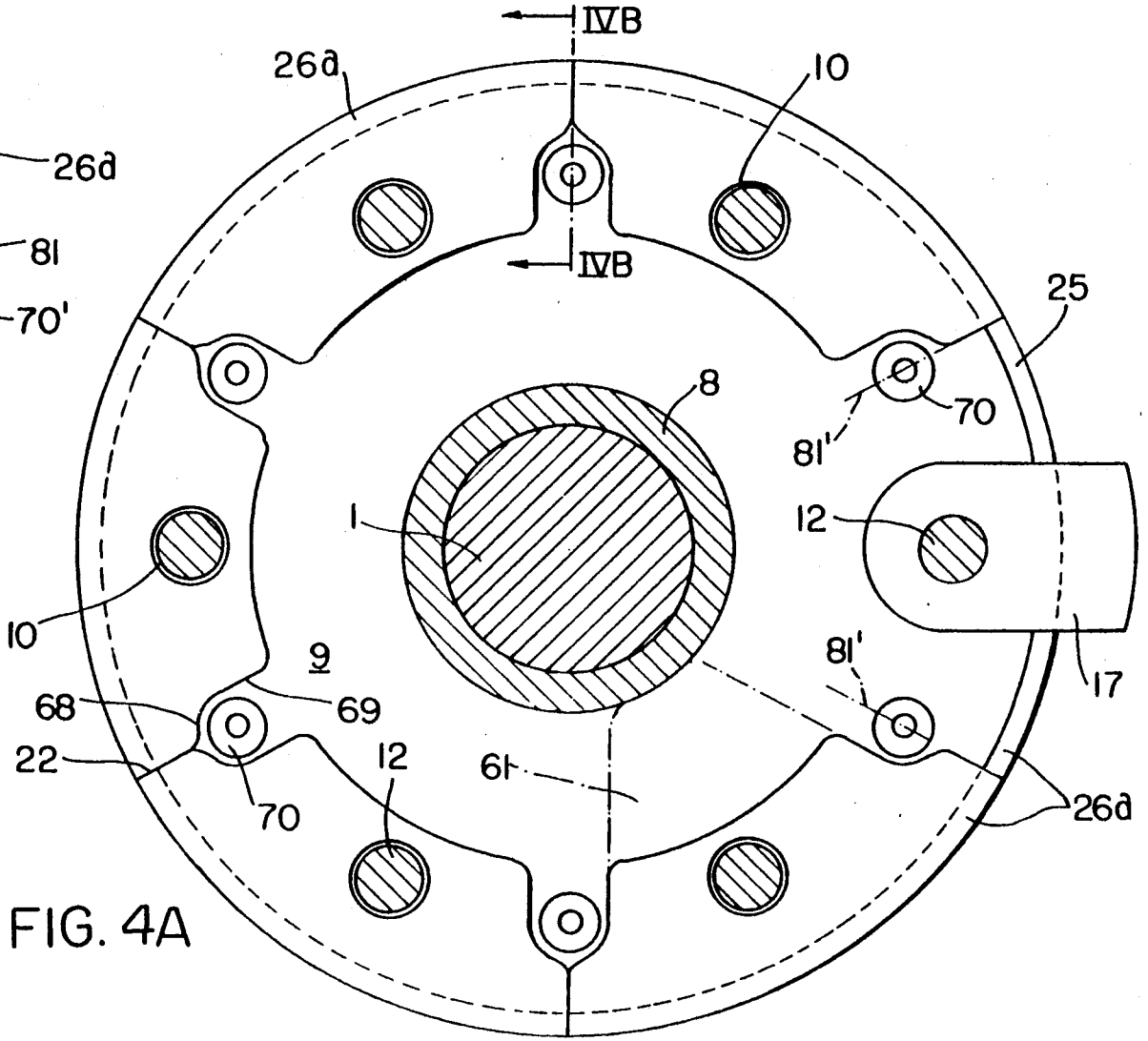
FIG. 4A is a view similar to that of FIG. 4, but showing a modification of the filler bodies and mounting means for the filler bodies.
Figure 4B:
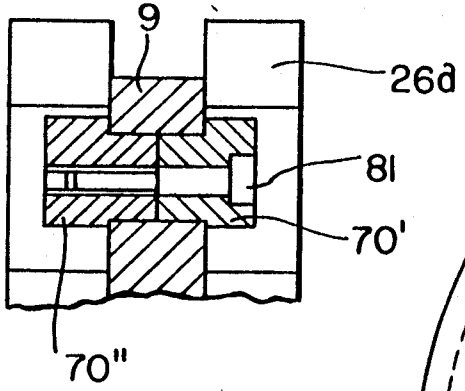
FIG. 4B is a detailed lengthwise section along section line IVB—IVB in FIG. 4A.
Figure 5A:
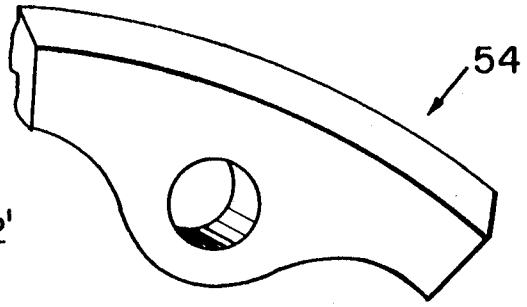
FIGS. 5A and 5B show two perspective views of two possible embodiments of filler bodies.
Figure 5B:
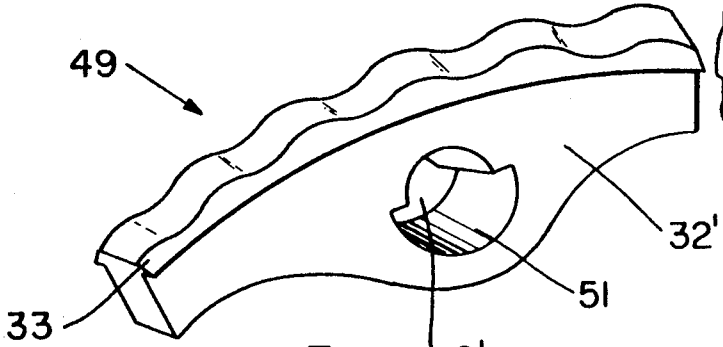

FIGS. 4A and 4B show a further embodiment for securing separate single element filler bodies 26a against rotating about a single axle rod 12 on which each filler body 26a is mounted. Each filler body 26a is flat-sided and protrudes radially beyond the outer circumferential surface 25 of the adjacent ring disks 9 so it can be installed in a hammer-crusher rotor, much as the filler body 19 shown in the upper left-hand portion of FIG. 1. In order to prevent the rotation of the filler body 26a about the axle rod 12, each filler body 26a comprises at each of its circumferential ends a side face 22, a radially inner transitional sloped surface 68, and another radially inner side face 69 located circumferentially closer to the center of the filler body 26a. Due to this arrangement a slit or slot opening radially inwardly is formed between each layer of respective adjacent filler bodies 26a with their respective side faces 22 arranged adjacent to one another, whereby the radially inwardly opening slot is bounded by the respective slope faces 68 and the radially inwardly located side faces 69. A contact head 70 is respectively inserted into each formed slot and is then secured to the neighboring ring disk 9. The radially inwardly facing surfaces of the sloped faces 68 are in contact with and are supported by the contact head 70. Preferably, the inner faces of the sloped surfaces 68 have a shape and size corresponding to the mating portion of the contact head 70. The contact head 70 may comprise two assembled oppositely located head halves 70' and 70'' which are inserted into a corresponding hole in the ring disk 9 and are connected to one another by a screw 81. This arrangement is shown especially in the sectional view of FIG. 4B.

The contact heads 70 which are arranged to the right and to the left of a neighboring hammer 17, as seen in the circumferential direction, must be spaced a sufficient distance away from the hammer 17 to remain clear of the hammer's rotational path as shown by the radial lines 81' in FIG. 4A. In order to achieve this, the contact heads 70 may have a different shape or may be cut away as needed to provide clearance for the hammer 17.

However, the contact heads 70 must not necessarily have the shape or arrangement of the heads 70 shown in FIG. 4B. Rather, the contact head 70 may be in the form of continuous rods passing through all of the ring disks in a manner similar to that of the axle rods 12.

FIG. 4A shows a further possible embodiment for transmitting forces and for securing the filler body 26a against self-rotation about the axle rod 12. As shown by dash-dotted lines, a support foot 61 may extend radially inwardly from the filler body 26a to contact and rest against the hub 8. In this embodiment a support foot 61 transmits forces from the filler body 26a directly to the hub 8, thereby unloading the axle rods 12. Furthermore, the support foot 61 prevents the rotation of the filler body 26a so that other securing means for the filler bodies, such as contact heads 70, become unnecessary.

Figure 11:
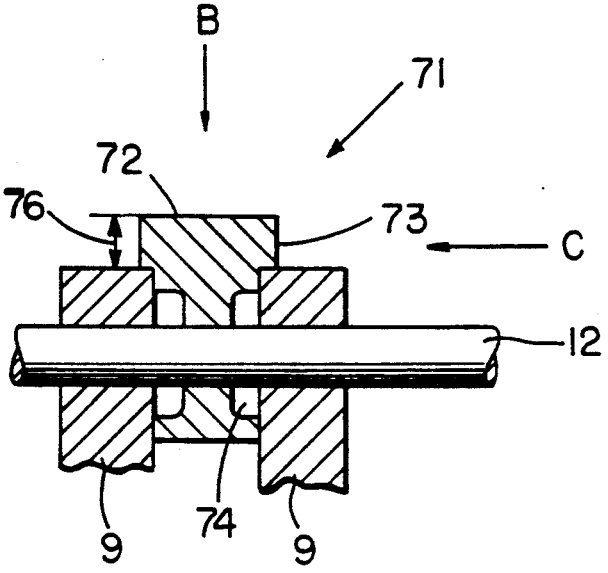
FIG. 11 is an axial sectional view along section line XI—XI in FIG. 12 showing a modified filler body.
Figure 12:
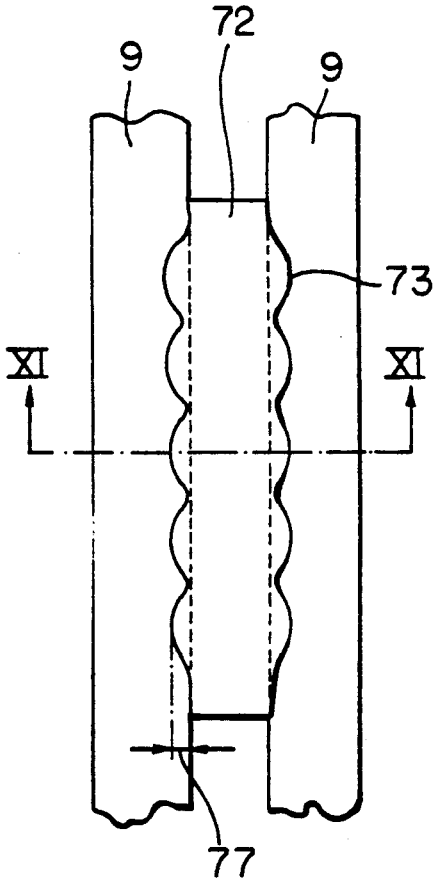
FIG. 12 is a radial view in the direction of the arrow B in FIG. 11.
Figure 13:
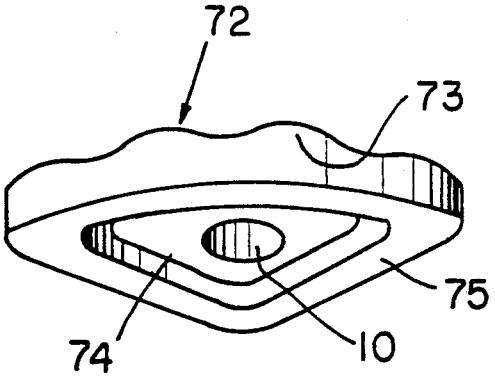
FIG. 13 is a detailed axial view in the direction of the arrow C in FIG. 11.

FIGS. 11 to 13 show still another embodiment for a filler body 71 having various features which could also be incorporated in the embodiments of the filler bodies described above.

FIG. 11 is an axial view and FIG. 12 is a radial top view in the direction of arrow B of FIG. 11 of a single filler body 71 arranged between two ring disks 9. The filler body 71 comprises a wavy surface profile 72 on its radially outwardly facing surface similar to the wavy surface of the filler bodies 32' shown in FIG. 5. The filler body 71 further comprises a radially outer head rim 76 which protrudes radially outwardly beyond the ring disk 9, whereby the side surface profile of the head rim 76 is also a wavy contour profile 73. The wavy side surface profile 73 protrudes by a height or axial distance 77 above a plane defined by side surfaces 75 of the filler body 71 as measured from the highest to the lowest point of the wavy contour. The lowest point of the wavy contour, for example, lies in the same plane as the flat side surfaces 75.

The filler body 71 is arranged between adjacent ring disks 9 and is secured in place by passing the axle rod 12 through a corresponding mounting hole 10 in a manner described in detail above for any of the filler bodies according to the invention. The filler body 71 may comprise at least one free space 74, such as an annular free space or separate free spaces in the portion of the filler bodies 71 arranged between adjacent ring disks 9. Such a free space 74 can considerably reduce the amount of material required and thereby reduce the cost and weight of the filler bodies 71 without impairing the function of the filler bodies 71. Such a weight saving shape can be provided for any of the filler bodies according to the invention described above. Furthermore, the described wavy surface contour or profile not only provides a protective function for the surfaces of the ring disks, but actually increases the effectiveness of the operation of the hammer-crusher rotor in that the wavy surfaces impart an additional crushing, shredding, or grinding effect on the material to be shredded.

Although the invention has been described with reference to specific example embodiments, it will be appreciated that it is intended to cover all modifications and equivalents within the scope of the appended claims.

What I claim:

1. An apparatus for protecting radially outward faces of spacer disks against wear and tear in a hammer-crusher rotor having a rotational axis, comprising a protective shield including at least one protective filler body constructed for placement in an axial gap between neighboring spacer disks, each protective filler body having a radially inner portion with axially facing side surfaces spaced from each other to fit at least partly into said gap and a radially outer portion with a circumferential surface having a contour substantially concentric with said rotational axis, said radially inner portion of said protective filler body and said radially outer portion with said circumferential surface of said protective filler body having substantially the same axial width, so that said radially outward faces of said spacer disks are substantially free of said protective filler body, each protective filler body having at least one mounting hole extending in parallel to said rotational axis, said apparatus further comprising mounting means including at least one axle rod passing through said at least one mounting hole in parallel to said rotational axis for positioning said radially outer circumferential surface contour of said protective filler body relative to said radially outward faces of said spacer disks so that said spacer disks are protected by said filler body without substantially covering said radially outward faces of said spacer disks.

2. The apparatus of claim 1, wherein said filler body is made of an especially wear resistant material, which is more wear resistant than the material of said spacer disks.

3. The apparatus of claim 1, wherein said radially outer circumferential surface contour of said filler body is substantially cylindrical and axially flush with said radially outward face of said spacer disks.

4. The apparatus of claim 1, wherein said radially outer circumferential surface of said filler body protrudes radially outwardly beyond said radially outward face of said spacer disks.

5. The apparatus of claim 1, comprising a plurality of said filler bodies arranged in each of said axial gaps between neighboring spacer disks.

6. The apparatus of claim 1, wherein each filler body has two mounting holes for receiving two respective axle rods, whereby a spacing between said mounting holes in said filler body corresponds to a distance between respective holes in said spacer disks for axially aligning said holes in said filler body with respective holes in said spacer disks.

7. The apparatus of claim 1, wherein said at least one mounting hole in said filler body has a cross-sectional hole shape with a first diameter over a first angular range and a second larger diameter over a second angular range, and wherein said mounting means further comprise a partially cylindrical shell sleeve extending through said at least one mounting hole with said second angular range of said filler body.

8. The apparatus of claim 7, wherein said second angular range is located on a side of said filler body mounting hole closer to said rotational axis.

9. The apparatus of claim 1, wherein said radially outer circumferential surface contour of said filler body comprises a wavy configuration over at least a portion of its surface.

10. The apparatus of claim 1, wherein said radially outer circumferential surface contour of said filler body comprises a toothed, ridged configuration over at least a portion of its surface.

11. The apparatus of claim 1, wherein said filler body further comprises a contact edge (33) extending along at least a portion of a circumferential width of said filler body for contacting said radially outward face of said spacer disks.

12. The apparatus of claim 1, wherein said mounting means comprise a groove in said radially outer surface contour of said filler body and a retainer bar arranged in said groove, and wherein said retainer bar extends axially from said filler body in a position contacting said radially outward face of said spacer disks.

13. The apparatus of claim 12, wherein said groove in said radially outer surface contour and said retainer bar each comprise a dovetail shaped cross-section.

14. The apparatus of claim 12, wherein a radially outwardly facing surface of said retainer bar is substantially flush with said radially outer surface contour of said filler body.

15. The apparatus of claim 1, wherein said mounting means comprise a bolt hole in said filler body, and a bolt arranged in said bolt hole and extending axially from said filler body, and wherein said bolt extends along and contacts said radially outward surface of said spacer disk.

16. The apparatus of claim 15, wherein a radially outermost portion of said bolt is substantially flush with said radially outer surface contour of said filler body.

17. The apparatus of claim 1, wherein said mounting means comprise at least one outrigger retainer member extending axially from said filler body.

18. The apparatus of claim 17, wherein a radially outer surface of said outrigger retainer lug is substantially flush with said radially outer surface contour of said filler body.

19. The apparatus of claim 17, wherein said outrigger retainer member is integrally formed with said filler body.

20. The apparatus of claim 17, wherein said outrigger retainer member comprises a semicircular cross-sectional shape and a substantially flat surface facing radially outwardly.

21. The apparatus of claim 17, wherein said outrigger retainer member comprises a dovetail shaped cross-section, with a narrower side of said dovetail cross-section facing radially outwardly.

22. The apparatus of claim 1, wherein said filler body comprises a radially extending circumferentially facing end face (22) at each of its ends, and wherein a circumferential distance (45) from the center of said at least one mounting hole in said filler body for receiving an axle rod, to a respective end face (22) corresponds at the most to one half of a circumferential distance between centers of two neighboring mounting holes in said spacer disks for receiving said axle rods.

23. The apparatus of claim 1, wherein said mounting means comprise a support foot extending radially inwardly from said filler body for resting on a member of said hammer-crusher rotor.

24. The apparatus of claim 1, wherein said filler body further comprises a radially outer head rim (62) having an axial width greater than an axial width of said filler body, said head rim having a radially inwardly facing contact edge at a transition from said filler body width to said head rim width, said contact edge being adapted for resting on a supporting rabbet groove of a neighboring spacer disk.

25. The apparatus of claim 1, wherein said filler body comprises a radially inner surface (63) and a uniform axial width over its entire radial extent, said uniform axial width corresponding substantially to a widened axial dimension of said axial gap, said radially inner surface being adapted for resting on supporting rabbet grooves of neighboring spacer disks.

26. The apparatus of claim 1, wherein said mounting means comprise at least one ridge protruding axially from each of said axially facing side surfaces of said filler body, said ridge extending substantially radially outwardly, at least over a portion of the respective side surface said ridge being adapted to fit into a respective mating groove in a respective spacer disk.

27. The apparatus of claim 26, comprising a plurality of ridges protruding from both opposite axially facing side surfaces of said filler body, said ridges being distributed so that ridges on one side surface are circumferentially staggered relative to the ridges on the opposite side surface.

28. The apparatus of claim 1, wherein said filler body comprises radially extending circumferentially facing end surfaces having a radially inwardly located portion and a radially outwardly located portion with a step (68) between both portions, said step (68) resting against a contact head extending axially from a neighboring spacer disk, whereby said step forms a sloped transition face supported by said contact head.

29. The apparatus of claim 1, wherein at least one of said axially facing side surfaces of said filler body comprises a non-planar profiled contour over at least a portion of its surface area.

30. The apparatus of claim 29, wherein said non-planar profiled contour is a wavy contour having wave crests and wave troughs extending approximately radially.

31. The apparatus of claim 29, wherein said non-planar profiled contour extends only over a head rim (76) portion of said axially facing side surface of said filler body, said head rim (76) protruding radially beyond said radially outward face.

32. The apparatus of claim 29, wherein said non-planar profiled contour has a lowest point substantially in a plane of said axially facing side surface, so that each non-planar contour extends with an axial height (77) above said axially facing side surface, whereby said axial height is defined between a highest point and a lowest point of said non-planar contour.

33. The apparatus of claim 1, wherein said filler body comprises hollow groove cavities for reducing a required material quantity.

* * * * *